US005471806A

United States Patent [19]

Rokhlin

[11] Patent Number: 5,471,806

[45] Date of Patent: Dec. 5, 1995

[54] CONSTRUCTION PANEL WITH PLURALITY OF CELLS

[76] Inventor: Zinoviy A. Rokhlin, 1626 Coney Island Ave., Brooklyn, N.Y. 11230

[21] Appl. No.: 314,785

[22] Filed: Sep. 29, 1994

[51] Int. Cl.[6] ..... E04C 2/36

[52] U.S. Cl. ..... 52/437; 52/580; 52/582.1; 52/793.11

[58] Field of Search ..... 52/807, 580, 582.1, 52/282.1, 808, 806, 421, 437

[56] References Cited

U.S. PATENT DOCUMENTS

| | | | |
|---|---|---|---|
| 903,300 | 11/1908 | Marvick | 52/437 X |
| 1,887,814 | 11/1932 | Gall | 52/807 |
| 3,339,326 | 9/1967 | Derr et al. | 52/808 X |
| 3,732,138 | 5/1973 | Almog | 52/806 X |
| 3,828,502 | 8/1974 | Carlsson | 52/580 X |
| 4,043,086 | 8/1977 | Kaulfuss et al. | 52/580 X |
| 5,157,892 | 10/1992 | Ryther | 52/807 X |

FOREIGN PATENT DOCUMENTS

| | | | |
|---|---|---|---|
| 264893 | 10/1964 | Australia | 52/807 |
| 695453 | 12/1930 | France | 52/437 |
| 699399 | 2/1931 | France | 52/806 |
| 1259434 | 3/1961 | France | 52/437 |
| 416052 | 11/1946 | Italy | 52/282.1 |
| 2267105 | 11/1993 | United Kingdom | 52/582.1 |

*Primary Examiner*—Carl O. Friedman
*Assistant Examiner*—Laura A. Saladino
*Attorney, Agent, or Firm*—Ilya Zborovsky

[57] ABSTRACT

A construction panel comprises two plates spaced from one another by a predetermined distance, and a plurality of strips extending transversely to one another and between the plates and connected with the plates so as to form a plurality of cells between the strips and the plates inside the panel.

5 Claims, 3 Drawing Sheets

CONSTRUCTION PANEL WITH PLURALITY OF CELLS

BACKGROUND OF THE INVENTION

The present invention relates generally to construction panels, in other words, to panels which are used in construction and related industries.

Construction panels are known in the art. Usually, the construction panels are composed of a solid material, porous material. It is believed that it is advisable to further improvement a strength to weight ratio of existing construction panels.

SUMMARY OF THE INVENTION

Accordingly, it is an object of the present invention to provide a construction panel which is a further substantial improvement over existing panels.

In keeping with these objects and with others which will become apparent hereinafter, one feature of the present invention resides, briefly stated, in a construction panel which has two substantially parallel plates arranged at a distance from one another, and a plurality of strips extending between said plates and transversely to one another so as to form a plurality of cells between said strips and said plates.

When the construction panel is designed in accordance with the present invention it is characterized by extremely high strength and low weight or in other words with a high strength to weight ratio. It also provides high heat insulating and sound insulating properties, has a lower consumption of materials and can be installed in shorter time than existing panels.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

p BRIEF DESCRIPTION OF THE DRAWINGS

DESCRIPTION OF THE PREFERRED EMBODIMENTS

Figure 1:
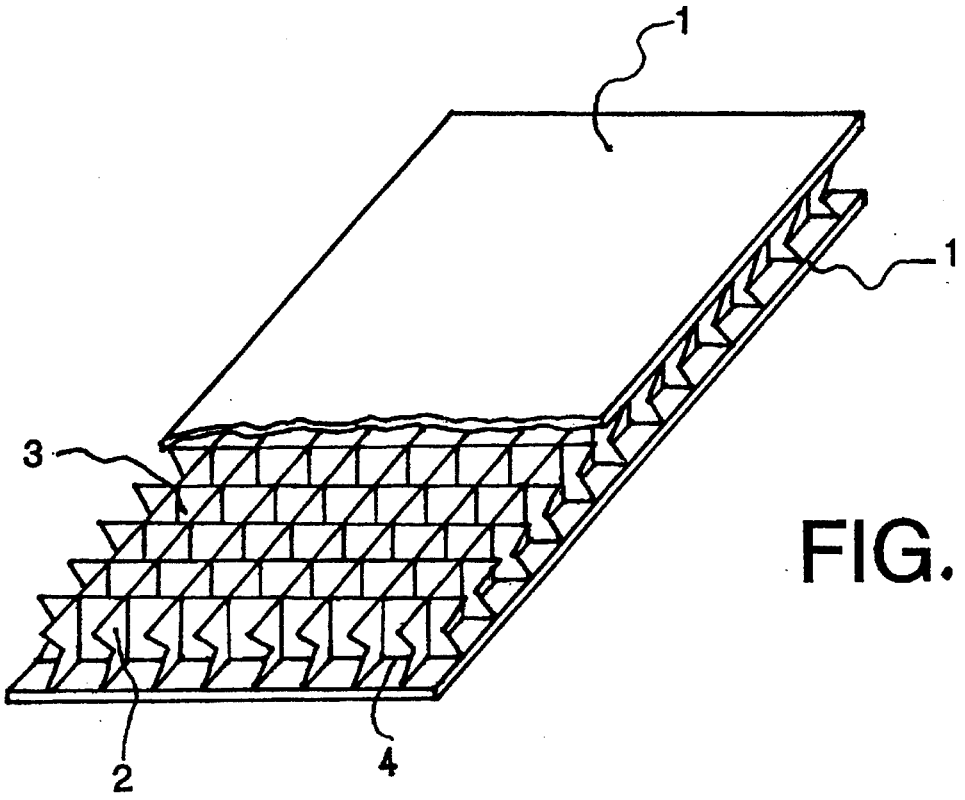
FIG. 1 is a view showing a construction panel in accordance with the present invention in perspective.

A construction panel in accordance with the present invention has two plates which are identified with reference numeral 1. The plates can be composed of dry wall, sheet rock, particle board, chip board, etc. They can be formed as substantially flat, homogenous sheets. Of course, on the other hand, they are not necessarily flat and can have other shapes. The plates 1 are spaced from one another by a predetermined distance. A plurality of strips 2 are located between the plates 1. The strips extend transversely to one another, preferably perpendicularly so as to form, together with the plates 1, a plurality of closed cells 3, as shown in FIG. 1.

Figure 2:
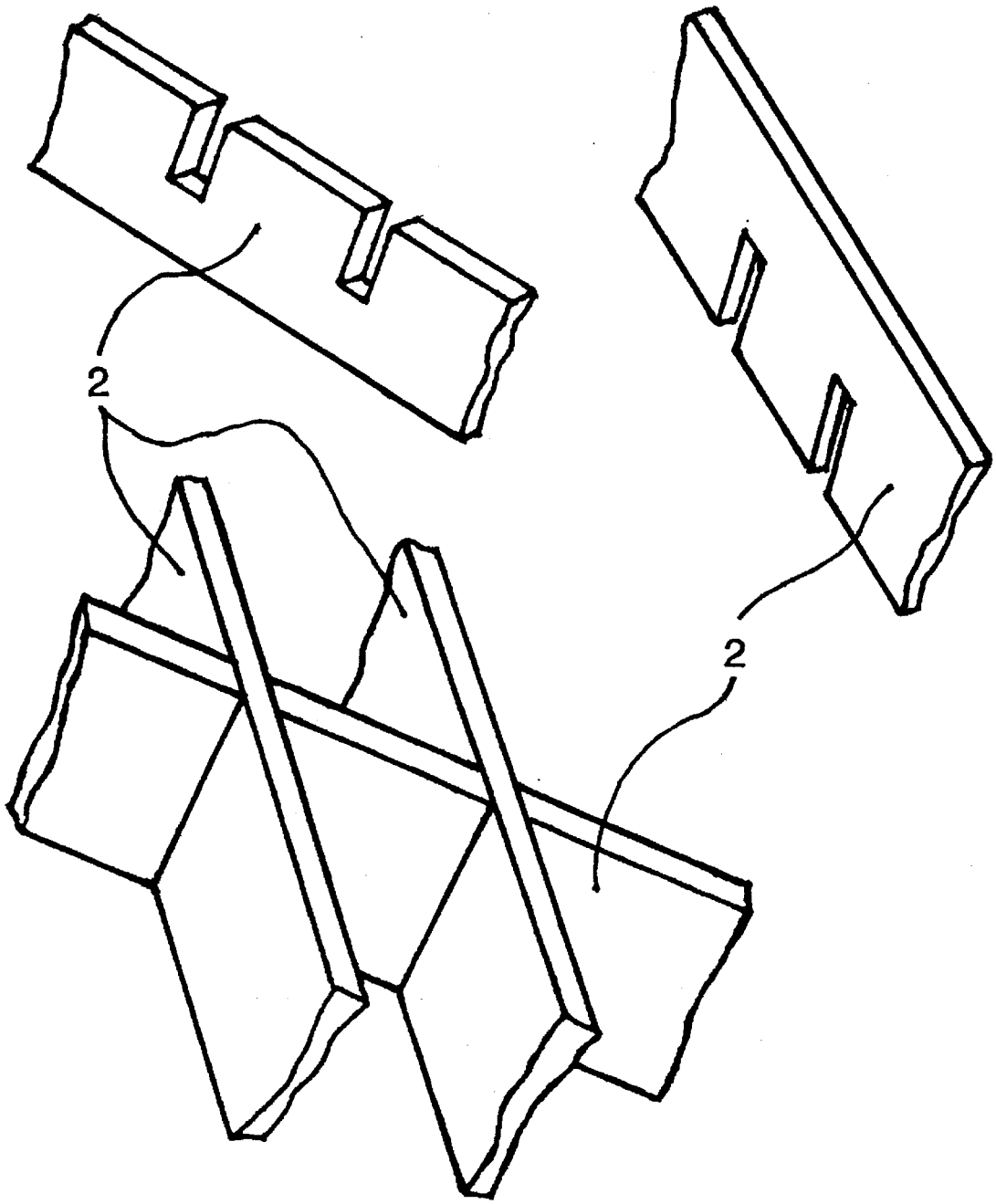
FIG. 2 is a view showing a fragment of the construction panel, in particular the area of intersection of strips located between plates of the panel.

As shown in FIG. 2 each strip has a plurality of slots. Preferably the slots in each strip extend over half of a height of the strip, so that when the strips are placed transversely to one another, the remaining unslotted portions of each strip are inserted in the slots of the opposite strip, as can be seen from FIG. 2. The strips can be composed of the same material as the plates, but also of any different material. As can be seen from the drawings, the strips include transverse strips and longitudinal strips. The strips can be made of light weight material, such as veneer or plastic.

Figure 3:
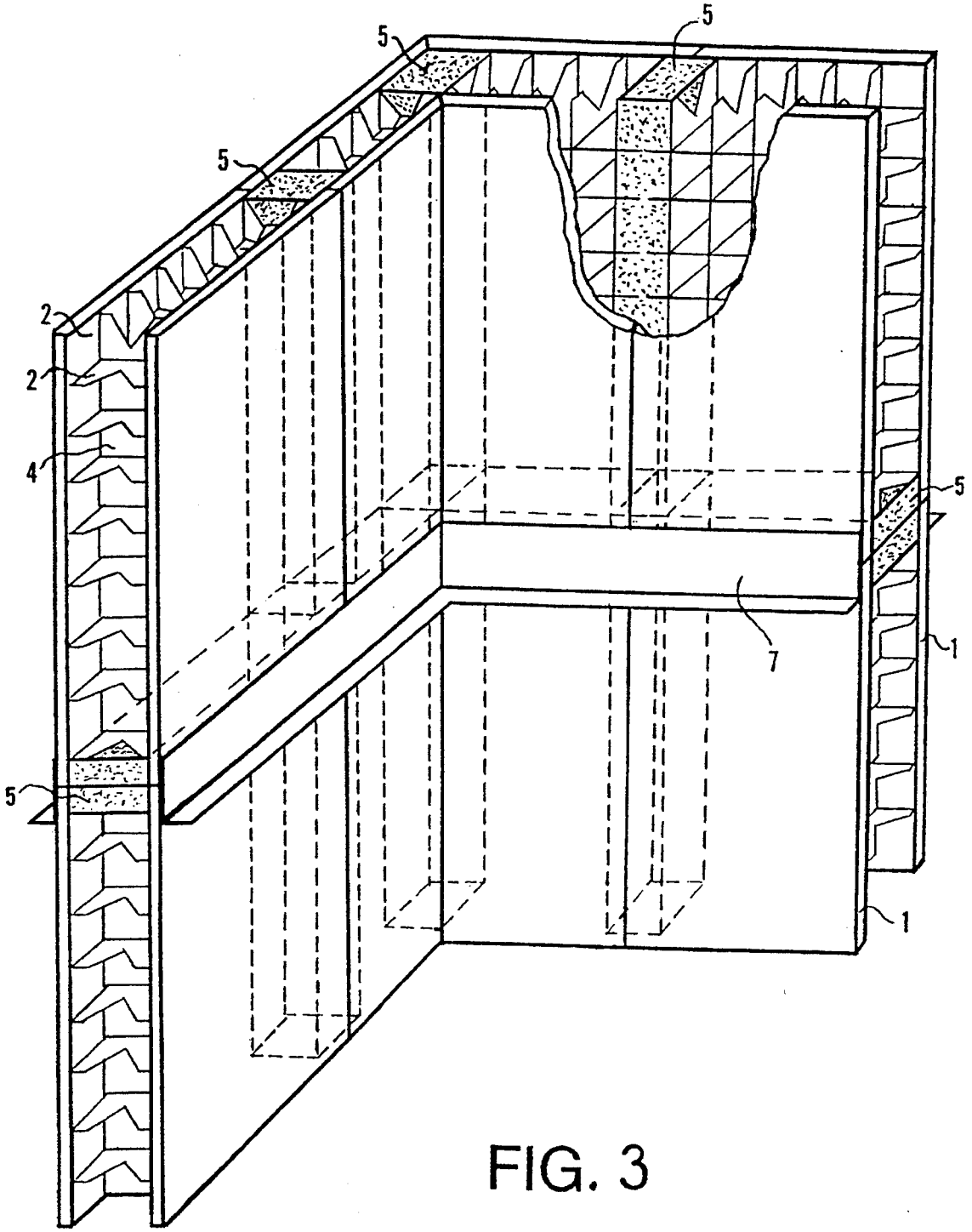
FIG. 3 is a view showing an assembly of walls from the construction panel in accordance with the present invention.

The plates can have a thickness of between 1–2 inch to 3–4 inch, while the strips can have a thickness of between 1–4 inch. The strips can be from 3 inch to 10 inch wide, and their slots can be spaced on one another by 6–8 inch. The total thickness of the panel can be between 3–4 inch to 1 inch. A typical size of the whole panel can be 4 feet–8 feet. However, it is to be understood that other sizes for each of the above mentioned elements can be provided as well. When the panel is assembled, it forms a structure including the above mentioned two plates with a plurality of ribs therebetween, separated by cavities. The cavities can be filled with a binding material, such as gypsum, cement, etc. Adhesive can be used for connecting the plates to the strips, and joining the transverse strips or the longitudinal strips with one another as well. As can be seen from FIG. 1, the edges of the strips are provided with wedge-shaped recesses. When the panels are assembled as shown in FIG. 3, with their ends facing one another, a space 5 is retained due to the wedge-shaped recesses 4 between the ends of the panels, which space can be filled with a binding material such as gypsum, cement, plastic, etc.

Figure 4:
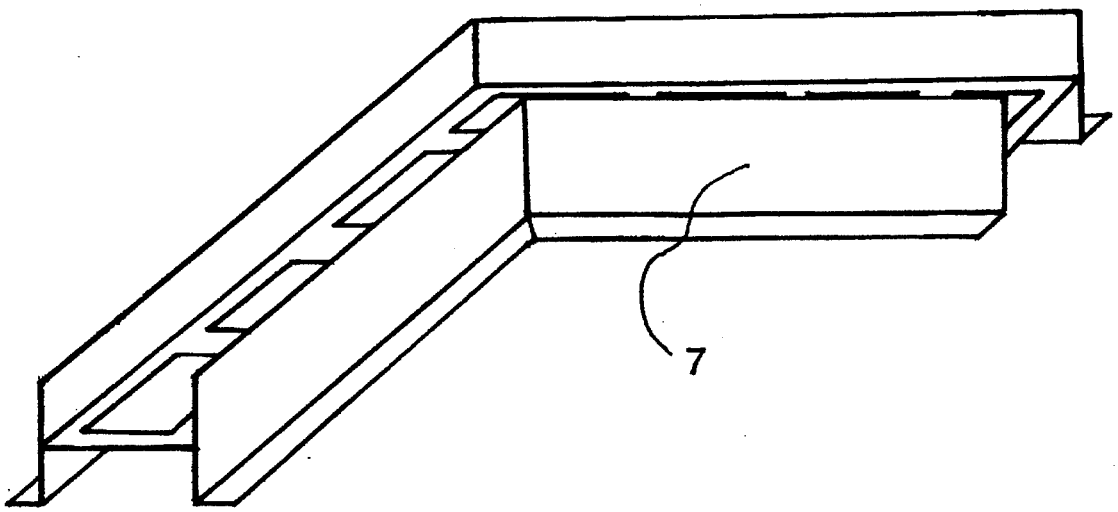
FIG. 4 is a view showing a connecting metal frame.

FIG. 4 shows a metal frame 7 which is used for assembling the panels in accordance with the present invention with one another. The metal frame 7 is located between the panels arranged vertically on one another so as to form vertical walls. Adhesive can be applied to the edges of the panels and the metal frame to connect the panels with the frame. The assembled panels can be attached to floors, walls, ceilings by binding material, or nails and glue, etc. Decorative cover moldings and other decorative elements can be applied to the inner corners to close the joint between the panels.

It will be understood that each of the elements described above, or two or more together, may also find a useful application in other types of constructions differing from the types described above.

While the invention has been illustrated and described as embodied in a construction panel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by

Letters Patent is set forth in the appended claims.

I claim:

1. A construction panel, comprising two plates spaced from one another by a predetermined distance; a plurality of strips extending transversely to one another and between said plates and connected with said plates so as to form a plurality of cells between said strips and said plates inside the panel, said strips having ends provided with wedge-shaped recesses so that when at least two such construction panels are located in abutment with one another a through-going space is formed by said construction panels; and a binding material located in said space.

2. A construction panel as defined in claim 1, wherein said strips include longitudinal strips and transverse strips, each of said strips being provided with slots so that the longitudinal strips are inserted into said transverse strips and vice versa.

3. A construction panel as defined in claim 1; and further comprising a binding material which fills said cells between said strips and said plates.

4. A construction panel as defined in claim 1, wherein said plates are composed of a material selected from the group consisting of drywall, sheet rock, particle board and chip board.

5. A construction panel as defined in claim 1, wherein said binding material is composed of a material selected from the group consisting of gypsum, cement and plastic.

* * * * *